US007641038B2

(12) United States Patent
El-Wardany et al.

(10) Patent No.: US 7,641,038 B2
(45) Date of Patent: Jan. 5, 2010

(54) PASSENGER CONVEYOR HANDRAIL AND METHOD OF MANUFACTURE

(75) Inventors: Tahany I. El-Wardany, West Hartford, CT (US); John M. Milton-Benoit, West Suffield, CT (US); Changsheng Guo, South Windsor, CT (US); John P. Wesson, Vernon, CT (US); Foster P. Lamm, South Windsor, CT (US); Detlev Lindemeier, Auhagen (DE)

(73) Assignee: Otis Elevator Company, Farmington, CT (US)

( * ) Notice: Subject to any disclaimer, the term of this patent is extended or adjusted under 35 U.S.C. 154(b) by 113 days.

(21) Appl. No.: 11/817,872

(22) PCT Filed: Apr. 8, 2005

(86) PCT No.: PCT/US2005/011924

§ 371 (c)(1),
(2), (4) Date: Sep. 6, 2007

(87) PCT Pub. No.: WO2006/110136

PCT Pub. Date: Oct. 19, 2006

(65) Prior Publication Data

US 2008/0271974 A1 Nov. 6, 2008

(51) Int. Cl.
*B66B 23/24* (2006.01)

(52) U.S. Cl. ..... 198/335

(58) Field of Classification Search ..... 198/335–337; 156/137

See application file for complete search history.

(56) References Cited

U.S. PATENT DOCUMENTS

| | | | | |
|---|---|---|---|---|
| 3,633,725 | A | 1/1972 | Smith | |
| 3,778,882 | A * | 12/1973 | Cameron et al. | 29/450 |
| 4,395,298 | A | 7/1983 | Wetzel et al. | |
| 4,852,713 | A * | 8/1989 | Tatai et al. | 198/337 |
| 4,946,020 | A * | 8/1990 | Rivera et al. | 198/335 |
| 6,237,740 | B1 | 5/2001 | Weatherall et al. | |
| 6,673,431 | B1 * | 1/2004 | Ledzinski | 428/292.1 |
| 6,761,259 | B1 * | 7/2004 | Onodera et al. | 198/335 |
| 7,243,775 | B2 * | 7/2007 | Novacek et al. | 198/337 |

FOREIGN PATENT DOCUMENTS

JP 2735453 B2 4/1998

OTHER PUBLICATIONS

International Preliminary Report on Patentability for International application No. PCT/US05/11924 mailed Feb. 27, 2008.
International Search Report and Written Opinion of the International Searching Authority for International application No. PCT/US05/11924 mailed Oct. 31, 2005.

* cited by examiner

*Primary Examiner*—Douglas A Hess
(74) *Attorney, Agent, or Firm*—Carlson, Gaskey & Olds PC

(57) ABSTRACT

A passenger conveyor (20) includes a handrail assembly (30) comprising a handrail (32) having a plurality of co-extruded polymer materials (34, 36). In one example, an outermost portion (34) establishes a passenger gripping surface (38). One example includes an extruded soft, low cost polymer in the middle of the handrail cross section to reduce cost and weight. A disclosed example includes a toothed driving surface (40) on an inner side made of a selected one of the polymer materials (34, 36). In one example, the driving surface (40) and the gripping surface (38) comprise the same polymer material.

19 Claims, 2 Drawing Sheets

PASSENGER CONVEYOR HANDRAIL AND METHOD OF MANUFACTURE

1. FIELD OF THE INVENTION

This invention generally relates to passenger conveyors. More particularly, this invention relates to making a handrail for a passenger conveyor.

2. DESCRIPTION OF THE RELATED ART

Passenger conveyors are well known. A plurality of steps typically follow a loop for carrying individuals between landings at opposite ends of the conveyor. A handrail is often provided so that passengers can stabilize themselves as they travel along on the conveyor.

A typical handrail design has a flat surface that faces upward with rounded edges. The body of the handrail is often made from laminated sheets of material using adhesives, heat or pressure to secure the layers together. Some rubber handrails have been made using a molding process.

One disadvantage to conventional handrail designs is that they do not provide an easily-gripped surface for a wide variety of passengers. A more ergonomically friendly design is desirable. Conventional manufacturing techniques, however, place limitations upon the shape of a handrail because of material cost and the bending stiffness required for a workable handrail.

Another shortcoming of conventional handrail designs is that they typically rely upon a pinching drive arrangement that utilizes friction between a handrail and a drive mechanism that creates a normal force against the handrail sufficient for causing the handrail to move with the steps of the passenger conveyor. Such arrangements often cause marking and scuffing on the outer surface of the handrail. This leads to premature replacement of a handrail.

An alternative drive arrangement is shown in Japanese Patent No. 2735453. In that document, rack teeth are formed on a handrail inner surface to cooperate with a drive mechanism for moving the handrail. While that document shows an improved driving arrangement for a handrail, the overall handrail design and method of manufacture are not ideal. Those skilled in the art are always striving to make improvements.

This invention provides an improved handrail design and manufacturing technique that allows for implementing non-conventional handrail shapes and an improved driving arrangement.

SUMMARY OF THE INVENTION

An example method of making a handrail for a passenger conveyor includes co-extruding a plurality of polymer materials to establish a passenger gripping surface from a first polymer material and an inner portion from a second polymer material. One example includes forming a toothed driving surface on the handrail. The toothed surface provides a drive surface for interacting with a drive mechanism that has a corresponding surface configuration.

One example handrail includes a plurality of co-extruded polymer materials. A first one of the polymer materials has properties that establish a gripping surface and a second one of the polymer materials has properties that establish high wear resistance, for example, in an inner portion. The handrail in one example includes a toothed driving surface.

The various features and advantages of this invention will become apparent to those skilled in the art from the following detailed description of a currently preferred embodiment. The drawings that accompany the detailed description can be briefly described as follows.

DETAILED DESCRIPTION OF THE PREFERRED EMBODIMENTS

Figures 1, 2:
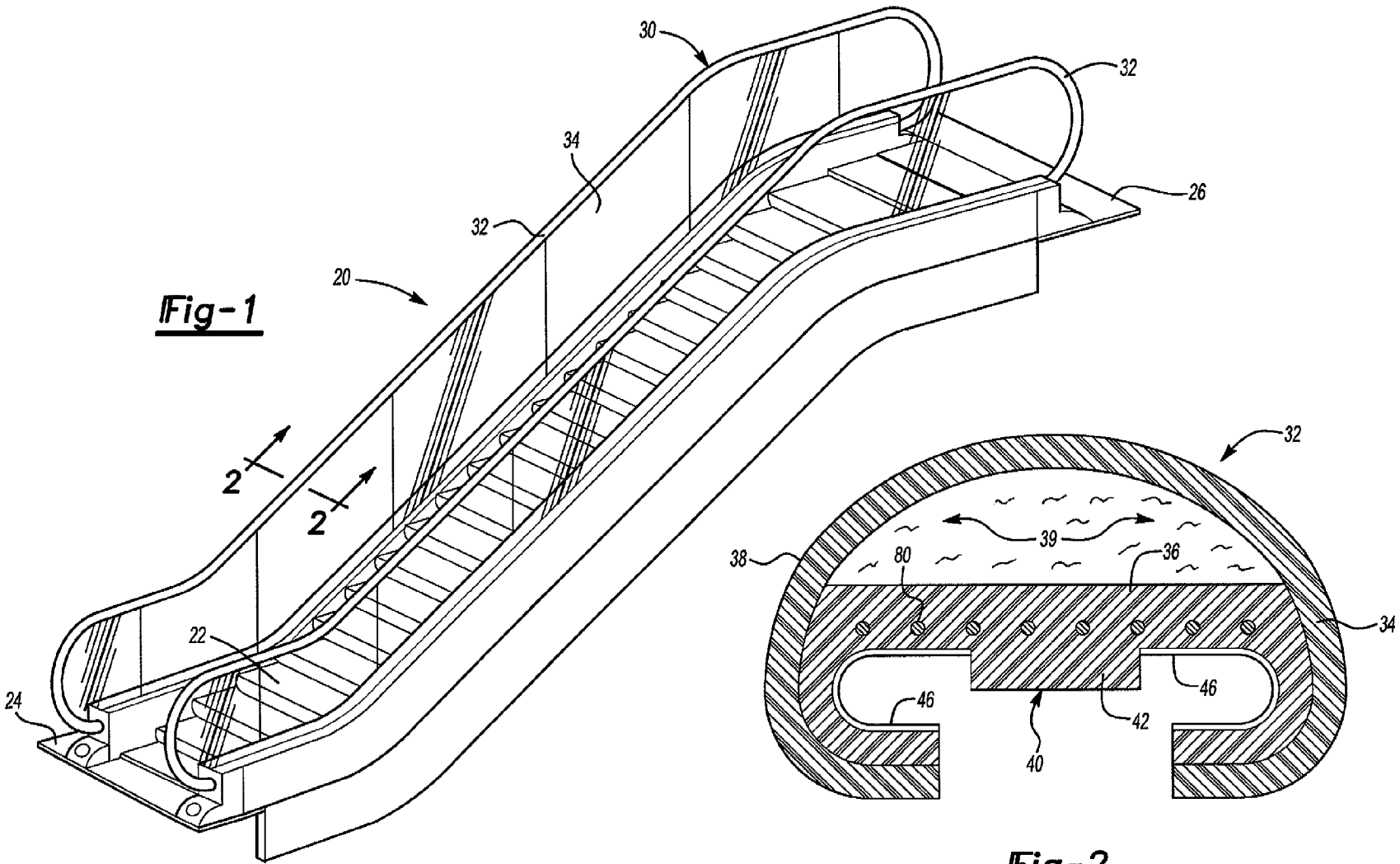
FIG. 1 schematically shows an example passenger conveyor incorporating a handrail designed according to an embodiment of this invention.
FIG. 2 is a cross-sectional illustration of an example handrail as seen along the lines 2-2 in FIG. 1.

FIG. 1 shows a passenger conveyor 20 that includes a plurality of steps 22 that move in a known manner for carrying passengers between landings 24 and 26. A handrail assembly 30 is associated with the plurality of steps 22 to allows passengers to brace themselves while riding on the conveyor 20. The handrail assembly 30 includes a handrail and a balustrade 34. A handrail guidance (not shown) facilitates the handrail 32 moving relative to the balustrade 34 to move in unison with the steps 22.

FIG. 2 shows, in cross-section, one example handrail 32 designed according to an embodiment of this invention. In this example, the handrail 32 comprises a plurality of polymer materials. In this example, a first polymer material 34 and a second polymer material 36 are shown. More than two materials may be used to meet the needs of a particular situation. Two materials are illustrated for discussion purposes. Those skilled in the art who have the benefit of this description will be able to select appropriate materials and combinations of them to meet the needs of their particular situation.

The first polymer material 34 in one example comprises a thermoplastic polyurethane. In this example, the first polymer material 34 forms a relatively hard outer surface 38 that provides a passenger gripping surface.

The second polymer material 36 establishes an inner portion of the handrail 32. Using a second material 36 allows for using a less expensive material on the inside of the handrail, for example. The outer layer or gripping surface 38 must have a certain durability on the surface, for example. The inner portion made of the second polymer material 36 need not have such a characteristic but should have reasonable wear resistance characteristics and cost-savings may be achieved by appropriately selecting one or more second polymer materials 36 to form the inner portion of the handrail 32.

In one example, the second material 36 has a stiffness corresponding to a strength in the range from about 40 to about 50 mega pascal. In one example, the material has a shore hardness in a range from about 80 to about 90. Given this description, those skilled in the art will be able to select an appropriate material to meet their particular needs.

Given the cross-section of the illustrated example, it is expected that relatively more raw material will be required for making the handrail 32 compared to conventional, more flattened-out designs. Using a plurality of materials allows for avoiding increased costs otherwise associated with a circular cross-section compared to the flattened-out designs of the past. In this example, there is some spacing that is not filled between the first polymer material 34 and the second polymer material 36. This spacing is shown in FIG. 2 at 39. Other examples may include a third polymer material filling that spacing. Such a third polymer material can be selected from even less expensive materials as it does not have any outside surface requirements associated with performance of the handrail. One advantage of the illustrated example is that material selections can be made that provide cost savings compared to conventional designs.

Additionally, selecting various polymer materials allows for controlling the stiffness and bending characteristics of the handrail so that a desired durability and surface texture can be achieved within given cost constraints. Those skilled in the art who have the benefit of this description will realize what material combinations will work best for their particular situation. Commercially available or custom designed materials may be used.

Figure 3:
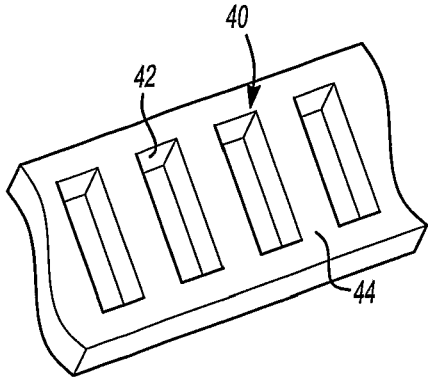
FIG. 3 schematically shows one example driving surface.
Figure 4:
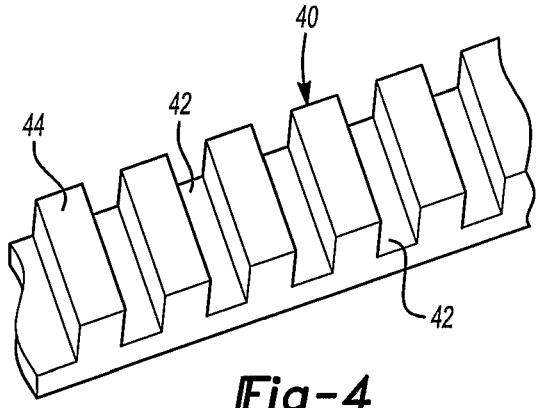
FIG. 4 shows another example driving surface.

One feature of the example of FIG. 2 is that a toothed driving surface 40 is provided on an "inner" side of the handrail 32. FIGS. 3 and 4 show example toothed driving surfaces 40. In each example, recessed portions 42 are interdigitated with teeth 44 that provide a drive surface to be engaged by a toothed sprocket or a toothed belt, for example. In the example of FIG. 3, the teeth 44 do not project outward beyond a finished inner surface on the handrail. In that example, the recesses 42 do not extend across the entire length of the drive surface 40. In the example of FIG. 4, the recesses 42 are like grooves across the entire width of the drive surface 40.

Referring again to FIG. 2, the illustrated example includes a low-friction material slider layer 46 that facilitates the handrail 32 moving along a guidance. In one example, the slider layer material is adhered to the second polymer material 36 after that is extruded and while the material is still warm enough to readily achieve a sufficient bond between the slider layer material and the second polymer 36. In another example, the slider layer is fed through the extrusion machinery and adheres to the material during the extrusion process. In one example, the low friction slider layer comprises a known material used for conveyor handrail slider layers.

Figure 5:
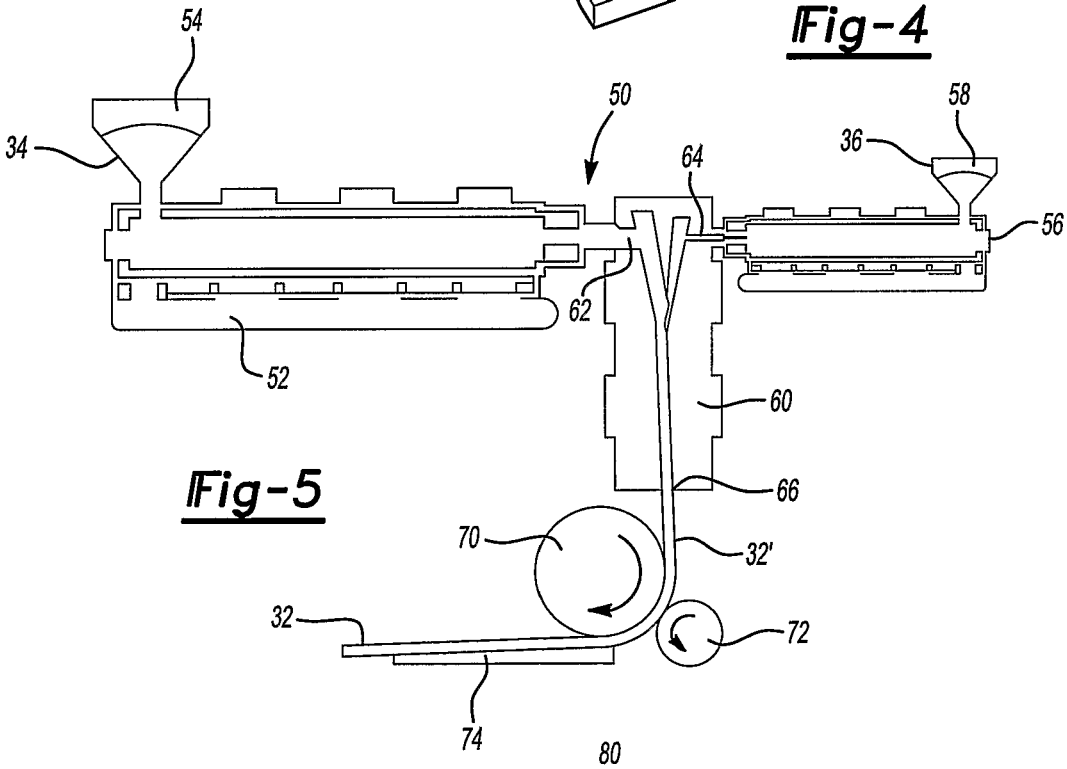
FIG. 5 schematically illustrates a method of making a passenger conveyor handrail according to one embodiment of this invention.

FIG. 5 schematically illustrates one example technique for forming the handrail 32 and establishing a toothed driving surface 40. In the example of FIG. 5, molding machinery 50 includes a first extruder 52 that extrudes a first one of the polymer materials 34, which is fed into the machinery 50 at 54. A second extruder 56 extrudes a second polymer material 36, which is fed in at 58. The outputs from the extruders 52 and 56 are provided to a common molding device 60. In this example, the molding device 60 has a plurality of manifolds 62, 64 as inputs for receiving the extruded materials 34 and 36. A single output 66 is shaped or includes a die to establish the configuration of the handrail 32.

The illustrated example uses co-extrusion of a plurality of polymer materials for forming the handrail. Co-extrusion techniques are known and those skilled in the art who have the benefit of this description will be able to select appropriate materials and techniques for achieving a handrail configuration to meet the needs of their particular situation. The example of FIG. 5 incorporates the use of the laminar flow principle that enables the two molten layers of material 34, 36 under proper operating conditions to join them in the common flow channel of the mold 60 with minimum intermixing of the materials at the contacting interface between them. This provides the multi-portion handrail design (i.e., an inner portion and an outer portion) as shown in FIG. 2, for example.

In this example, two chambers following the manifold inlets 62 and 64 each include a width, length and height with a required cross-section to establish the corresponding portions of the handrail. The resulting product 32' is stretched in the air and then passed through an arrangement for finishing the handrail. In the example of FIG. 5, a first wheel 70 engages the driving surface 40 on the "inner" side to establish the toothed driving surface 40. In one example, the wheel 70 has a serrated exterior that induces the teeth on the driving surface 40 by cutting or pressing the extruded handrail material to form the recesses 42.

In the example of FIG. 5, a gripping surface finishing wheel 72 engages the gripping surface 38 and establishes a desired texture for the gripping surface. At the end of the process, a cooling bath 74 cools the materials of the handrail 32 so that it can be handled in a known manner for packaging and shipping to a job site.

In another example, the toothed driving surface 40 is established during the co-extrusion process. As shown in FIG. 2, a load bearing member 80 is provided within the handrail 32. In this example, a plurality of steel cords are supported at least partially within the second polymer material 36 to provide the load bearing member 80. In one example, the toothed driving surface 40 is established in connection with providing the load bearing member 80 within the handrail 32.

Figure 6:
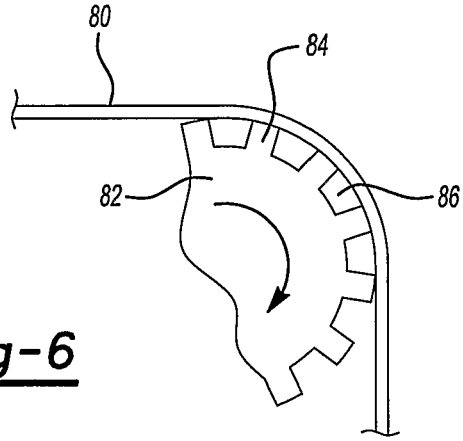
FIG. 6 schematically illustrates a selected portion of another example method.

FIG. 6 schematically shows a mold wheel 82 that is included as part of the extrusion machinery in one example and has a plurality of projections 84 and recesses 86. The steel cords of the load bearing member 80 are supported along the projections 84 in the extrusion machinery so that the appropriate polymer material at least partially encases the load bearing member 80 and fills the recesses 86 on the mold wheel 82. As the extruded material and the load bearing member 80 leave the mold wheel 82 the material already has a driving surface similar to that shown in FIG. 4. In such an arrangement, the wheel 70 of FIG. 5 may be a guiding wheel without a serrated exterior surface to guide the handrail 32 toward the cooling bath 74. The wheel 72 in such an example may be textured to provide a desired texture on the gripping surface on the handrail 32. One example includes a control system for adjusting a required forming pressure on the driving surface 40.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of making a handrail for a passenger conveyor, comprising:

co-extruding a plurality of polymer materials to establish a passenger gripping surface from a first one of the polymer materials and an inner portion from a second one of the polymer materials; and forming a toothed driving surface including a plurality of teeth spaced from each other in a lengthwise direction on the handrail.

2. The method of claim 1, including forming the toothed surface after co-extruding the first and second polymer materials.

3. The method of claim 2, including urging at least one surface of the extruded materials against a wheel that has an outer surface for forming the toothed driving surface.

4. The method of claim 3, including cooling the materials after forming the toothed surface.

5. The method of claim 1, wherein the first polymer material comprises thermoplastic polyurethane.

6. The method of claim 1, including providing at least one load bearing member within at least one of the polymer materials.

7. The method of claim 6, wherein the load bearing member comprises a plurality of cords and the method includes at least partially surrounding the cords with at least one of the materials.

8. The method of claim 7, including supporting the plurality of cords on a mold wheel and forming the toothed surface using the mold wheel.

9. The method of claim 8, including forming the toothed driving surface using the mold wheel before completing the co-extruding.

10. The method of claim 8, including forming the toothed driving surface prior to the co-extruding.

11. The method of claim 1, including forming the toothed driving surface prior to the co-extruding.

12. The method of claim 1, comprising providing the handrail with a first thickness at a location of each of the teeth and a second, different thickness at a location of each space between the teeth.

13. A passenger conveyor handrail, comprising:

a plurality of co-extruded polymer materials, a first one of the polymer materials establishing a gripping surface and a second one of the polymer materials establishing an inner portion, the handrail including a toothed driving surface having a plurality of teeth spaced from each other in a lengthwise direction along the handrail and a spacing between at least a portion of the first one of the polymer materials and a corresponding portion of the second one of the polymer materials.

14. The handrail of claim 13, including a third polymer material filler at least partially filling the spacing between the first and second polymer materials.

15. The handrail of claim 14, including at least one load bearing member supported within at least one of the polymer materials.

16. The handrail of claim 13, wherein the first polymer material comprises a thermoplastic polyurethane.

17. The handrail of claim 13, including a low-friction slider layer adjacent at least some of the inner portion.

18. The handrail of claim 13, wherein the toothed driving surface comprises the second polymer material.

19. The handrail of claim 13, wherein the handrail has a first thickness at the location of each of the teeth and a second, different thickness at a location of each space between the teeth.

* * * * *